US006554182B1

(12) United States Patent
Magnusson et al.

(10) Patent No.: US 6,554,182 B1
(45) Date of Patent: Apr. 29, 2003

(54) PACKAGING CONTAINER FOR THE COLD STORAGE OF LIQUID FOODS AND A METHOD OF PRODUCING THE PACKAGING CONTAINER

(75) Inventors: Tommy Magnusson, Södra Sandby (SE); Rolf Borgström, Lomma (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 09/462,141

(22) PCT Filed: Jul. 9, 1998

(86) PCT No.: PCT/SE98/01359

§ 371 (c)(1),
(2), (4) Date: Jan. 4, 2000

(87) PCT Pub. No.: WO99/05029

PCT Pub. Date: Feb. 4, 1999

(30) Foreign Application Priority Data

Jul. 28, 1997 (SE) ..... 9702807

(51) Int. Cl.[7] ..... B65D 5/74

(52) U.S. Cl. ..... 229/125.42; 493/134; 493/142; 493/287; 493/341; 493/394

(58) Field of Search ..... 493/121, 134, 493/135, 142, 144, 287, 341, 342, 394; 206/830, 527; 229/125.42, 48 R, 48 T, 198.2

(56) References Cited

U.S. PATENT DOCUMENTS

| | | | | | |
|---|---|---|---|---|---|
| 3,495,507 | A | | 2/1970 | Haas et al. | 229/137 |
| 3,654,842 | A | * | 4/1972 | Schwenk | 493/287 |
| 4,239,150 | A | * | 12/1980 | Schadowski et al. | 229/48 |
| 4,909,434 | A | | 3/1990 | Jones et al. | 229/125.15 |
| RE34,122 | E | * | 11/1992 | Sheehan et al. | 156/327 |
| 5,236,408 | A | * | 8/1993 | McAdam, III et al. | 493/355 |
| 5,385,527 | A | * | 1/1995 | Fukada et al. | 493/135 |
| 5,575,418 | A | * | 11/1996 | Wu et al. | 229/3.5 R |
| 5,810,243 | A | * | 9/1998 | Dipinto et al. | 229/198.2 |
| 5,846,619 | A | * | 12/1998 | Cahill et al. | 428/34.2 |
| 5,939,483 | A | * | 8/1999 | Kueppers | 524/271 |
| 6,319,979 | B1 | * | 11/2001 | Dubois et al. | 156/334 |
| 6,325,878 | B1 | * | 12/2001 | Borgstrom | 156/497 |

FOREIGN PATENT DOCUMENTS

| | | | | |
|---|---|---|---|---|
| DE | 27 21 390 A1 | | 11/1978 | B65D/5/40 |
| EP | 0-237235 A2 | * | 9/1986 | B65D/5/00 |
| EP | 0 673 843 A1 | | 9/1995 | B65D/5/06 |
| JP | 1199847 | * | 8/1989 | B65D/5/56 |

* cited by examiner

*Primary Examiner*—Rinaldi I. Rada
*Assistant Examiner*—Hemant M. Desai
(74) *Attorney, Agent, or Firm*—Burns, Doane, Swecker & Mathis, L.L.P.

(57) ABSTRACT

The disclosure relates to a packaging container for long-term cold storage of liquid foods for retaining superior flavor and aroma properties in the packed product, and produced from a packaging laminate including a core layer of paper or paper-board, an inside aroma barrier layer of PET and a gas barrier layer, by fold formation and sealing of a planar packaging blank so that all contact surfaces vis-a-vis the packed product consist of the PET layer. The disclosure also relates to a method of fold forming and sealing the packaging laminate into a packaging container according to the invention. Good shelf-life after cold storage for at least six weeks at 8° C., or at least 10 weeks at 4° C. will be attained using the packaging container according to the invention.

18 Claims, 2 Drawing Sheets

Figure 1:
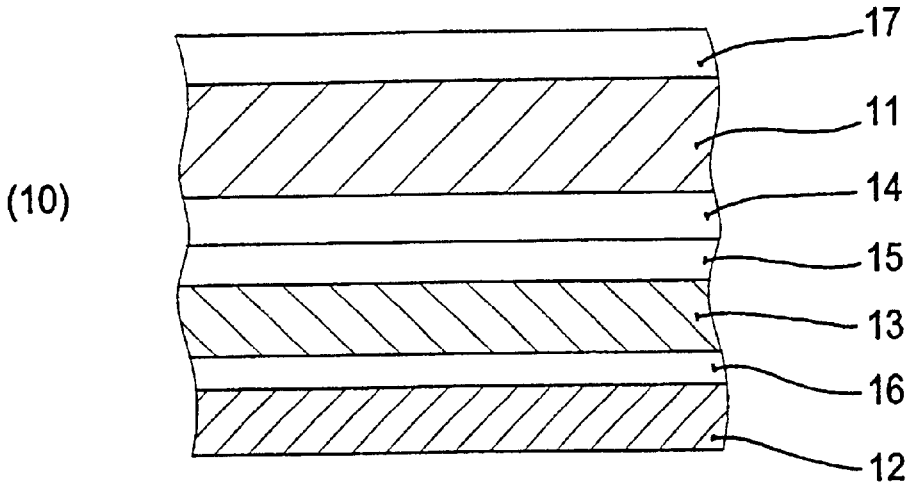

PACKAGING CONTAINER FOR THE COLD STORAGE OF LIQUID FOODS AND A METHOD OF PRODUCING THE PACKAGING CONTAINER

TECHNICAL FIELD

The present invention relates to a packaging container for the cold storage of liquid foods, for retaining superior flavour and aroma properties in the packed product, the container being of the type which is produced by fold forming and sealing of a planar, substantially rectangular or quadratic packaging container blank comprising side wall panels, top panels and bottom panels, for the formation of a tubular blank with a longitudinal sealing joint between the overlapping longitudinal incision edges of the packaging container blank, the tubular blank thereafter being given the desired bottom and top closures by fold forming and sealing of the bottom and top panels, respectively, of the packaging container blank, the packaging container blank being produced from a laminated packaging material comprising a core layer of paper or paperboard, an outer, aroma barrier layer of PET and a gas barrier layer disposed between the core layer and the aroma barrier layer. The present invention also relates to a method of producing such packaging containers.

BACKGROUND ART

Use has long been made within the packaging industry of packages of a single-use nature (so-called single-use disposable packages) for packing and transporting products such as liquid foods. A very large group of these single-use disposable packages is produced from laminated packaging material based on an interjacent core layer of paper or paperboard and outer laminate layers of some thermosealable plastic possessing superior liquid barrier properties, normally such as low density polyethylene (LDPE).

Depending on what food product is to be packed, i.e. its composition and storage sensitivity, its shelf-life, additional laminate layers—or laminate layers of other types than LDPE—may be included in the laminate structure. Examples of such additional or other laminate layers may be material layers possessing superior gas barrier properties, such as an aluminium foil or a layer of polyamide or of copolymers of ethylene and vinyl alcohol. Certain food products, such as juice, moreover place more stringent requirements to the effect that the packaging material possess superior aroma barrier properties, i.e. prevent flavour deterioration as a result of non-polar flavour and aroma substances being absorbed from the packed product into the packaging material. At the same time as the package must afford the product the best possible product protection properties, production of such single-use packages must also be simple and rational in order to be economically viable.

Within the prior art technology, polyethylene terephthalate (PET) has often been proposed as a material possessing superior aroma barrier properties, suitable for the inside layer in a packaging container for direct contact with the packed product, as opposed to, for example, LDPE. PET possesses extremely good barrier properties against essential oils such as D-limonen and other non-polar flavour and nutrient substances in, for example, orange juice and is, therefore, a highly desirable material for this purpose. However, PET suffers from the major drawback in employment as the innermost laminate layer in a packaging container for direct contact with the packed product in that it is difficult to thermoseal at rational production speeds, in particular on sealing of the longitudinal joints in a packaging container produced from a sheet-shaped packaging laminate blank in which the longitudinal edges of the sheet-shaped blank overlap one another and are exposed such that the outside of the inner edge is sealed against the inside of the outer edge. In rational production of conventional packaging containers, such longitudinal joint sealing takes place at very high speeds, in that the sheet-shaped blanks in rapid sequence are advanced, reformed and longitudinally sealed by means of thermosealing into tubular packaging container blanks. The term "tubular" is hereafter taken to signify tubes of both circular and quadratic or rectangular cross section. For thermosealing of PET, it is necessary that the pressure from the sealing jaws is maintained during the heating process, at least up to approximately 165° C., which takes roughly 0.5 sec. However, the available stay time during the sealing process on sealing of longitudinal joints, i.e. the time during which the pressure from the sealing jaws is maintained, is only approx. 0.01 sec., and thereby insufficient. On the other hand, sealing of the top and bottom of the same packaging containers takes place intermittently in connection with the product being filled into the container, which permits longer stay times in the sealing operation proper, and thereby makes for thermosealing by means of surface fusion between two PET layers.

Attempts have been made to overcome these difficulties in various manners, for example by employing a modified PET which facilitates thermosealing. From, for example, European Patent Application EP 0 237 235, it is known that glycol-modified PET, so-called PETG, may be thermosealed. However, a serious drawback inherent in this glycol-modified PET is that it results in a more brittle material layer with less flexibility and durability and is thus not as desirable in a packaging laminate as normal, amorphous, non glycol-modified PET. Moreover, nor can thermosealing take place using PETG at such high production speeds as are actually desirable.

One method of attempting to circumvent the difficulties of longitudinally sealing normal PET by means of thermosealing has been instead to seal the longitudinal lap joints by means of hot melt glue sealing, by applying a hot melt glue along one edge and then compressing it with the other edge in the lap joint between the two edges. However, it has not hitherto been possible to achieve rational sealing speeds using this technique. It has not hitherto been possible to use hot melt glue application at acceptable speeds, and serious problems have been encountered with large spillage of hot melt glue and with the fact that the application of the hot melt glue becomes uneven, with tacky outflows as a result. Another difficulty in the striving to produce a packaging container possessing superior aroma barrier properties is that such a hot melt glue sealed longitudinal joint is not durable in cold storage. Such a packaging container has thus not hitherto been capable of being stored for a lengthy period of time with good liquid-, gas-, and aroma barrier properties, because of the fact that the hot melt glue sealed longitudinal joint becomes untight.

In respect of liquid-, gas-, and aroma barrier properties, such incision edges of the sheet-shaped packaging blank which are freely exposed to the packed product create problems in that gas and liquid molecules, like non-polar flavour substances, are slowly absorbed in the packaging material through the thus freely exposed incision edges.

Another drawback is that configurationally stable, strong and durable packaging containers according to the prior art technology normally require larger quantities of the materials included in the package in order to achieve improved stability and improved barrier properties, despite lengthy cold storage, and thus command a higher price.

Hence, it has not hitherto been possible in the prior art technology, in a cost effective and rational manner to longitudinally joint seal and produce fold-formed packaging containers from sheet-shaped blanks of a paper-based packaging laminate with inside layers of PET which possess retained superior gas and aroma barrier properties also in the lengthy cold storage of liquid foods.

OBJECTS OF THE INVENTION

One object of the present invention is therefore to realise a novel packaging container of the type described by way of introduction without the attendant problems of the type intimately to the prior art technology.

A further object of the present invention is to realise a configurationally stable packaging container possessing superior gas and aroma barrier properties for packing and lengthy cold storage of liquid foods, from a sheet-shaped blank of a packaging laminate.

One particular object of the present invention is to realise a fold-formed packaging container which, in terms of material consumption and production process, is cost effective and which, also during lengthy cold storage of liquid foods, maintains good configurational stability and good gas and aroma barrier properties.

Yet a further object of the present invention is to realise a simple and rational method of producing a packaging container possessing superior lengthy cold storage properties according to the present invention.

OUTLINE OF THE INVENTION

The point of departure for attaining the desired aroma barrier properties in a packaging container for lengthy storage of liquid foods is thus a packaging laminate comprising an inside layer, i.e. that layer which is turned to face inwards in a packaging container produced from the packaging laminate, for direct contact with packed product, possessing superior aroma barrier properties, such as polyester, suitably PET, and preferably amorphous PET. Certain current process-facilitating additives employed in the prior art technology may be added to amorphous PET for facilitating extrusion and application of such a film or layer of PET.

Suitable core layers in packaging laminates for packaging containers according to the invention consist of paper or paperboard of suitable packaging quality.

To obtain superior gas barrier properties for protecting the packed product, such as, for example, the vitamin C content of orange juice, a separate layer is required of a material possessing superior gas barrier properties. Polymer gas barrier materials are today most desirable in the new development of packaging materials, since, from both the point of view of recycling and the environment, and from the point of view of costs, they are deemed to be preferable. Well-known polymer gas barrier materials are, for example, polyamide (PA) or copolymers of ethylene and vinyl alcohol (EVOH). The most preferred material alternative for the packaging container according to the pertinent invention is polyamide or a mixture of different polyamides because of their excellent gas barrier properties and inherent material rigidity. Mixtures of substantially polyamide and PET or EVOH are well-functioning gas barrier alternatives in a packaging container according to the present invention.

A further surprising advantage with a packaging laminate including an inner layer of PET and a gas barrier layer of substantially PA is that such aroma and gas barrier layers independently make considerable contributions to the total rigidity of the packaging laminate and that the rigidity of the core layer is, as a result, not as critical. By optimising the material quantity in the core layer and each respective barrier layer, a cost effective packaging laminate can be obtained given the qualitative advantages which are achieved at the same time. It has surprisingly proved that, when a PET layer with a grammage of approx. 18–30 g/m$^2$ is combined with PA layer with a grammage of approx. 5–15 g/m$^2$, it is possible, with retained overall rigidity, to employ a "weaker" and therefore cheaper paper for the core layer. By such means, the rigidity of the paper core layer may be reduced from 360 mN to between 280 and 340 mN. A preferred paper core layer according to the invention thus has a rigidity of approx. 280–340 mN, preferably approx. 290–330 mN.

Preferably, the PET layer has a grammage of approx. 18–25, most preferably approx. 20 g/m$^2$ for optimum aroma barrier properties, which, in measurement tests, has been defined as an at least 90% retention of D-limonen in the packed product. The grammage should preferably not be less than 20 g/m$^2$, but the aroma barrier layer functions well even at approx. 18 g/m2.

The gas barrier layer is thus constituted preferably by PA and is then applied preferably in a quantity of approx. 8–12 g/m$^2$, most preferably approx. 10 g/m$^2$, which gives optimum gas barrier and rigidity properties.

The gas barrier layer may be laminated to the core layer by means of an interjacent layer of LDPE and/or an adhesive layer of an adhesive polymer, such as, for example, an acid-modified polyethylene. For example, adhesives of the type maleic acid anhydride-modified polyethylene function very well according to the invention. Preferably, the gas barrier layer is laminated to the core layer by means of a lamination layer of LDPE most proximal the core layer and an adhesive layer between the LDPE layer and the gas barrier layer, for obtaining optimum adhesion and laminate strength. However, it is also conceivable, depending on the quality and properties of the polyamide layer, that this is applied direct on the core layer by means of extrusion.

Preferably, the inside/aroma barrier layer is laminated to the gas barrier layer with the aid of an interjacent adhesive layer of the same type of acid-modified polyethylene.

On the outside of the packaging laminate, i.e. that side which forms the outside of a packaging container produced from the packaging laminate, a layer of a thermosealable polymer—preferably LDPE—is suitably applied.

With a view to achieving the requisite superior gas and aroma barrier properties in lengthy cold storage of the packaging container according to the present invention, it is important to protect the incision edges of the sheet-shaped packaging blank from contact with the packed product in the packaging container. This may be put into effect in different, per se known manners, for example by applying separate protective strips over the incision edges. Since the problem with difficultly sealable PET layers remains unsolved, the covering of the incision edges with separate strips is not a good solution.

By, instead, splitting and partly removing, by so-called "skiving", the longitudinal edge of the sheet-shaped packaging laminate blank which is on the inside of a container produced from the packaging blank, i.e. the inner edge, for the formation of a projecting strip of half of the thickness of the packaging laminate including the inside layer of PET and folding back and sealing the projecting strip against the outside of the packaging laminate, the incision edge is concealed behind the outer edge (see FIG. 2) and, thus, does not come into contact with the packed product. The skived and double folded strip is sealed against the outer overlapping edge's PET inside, which avoids the situation that incision edges and other material than PET come into direct contact with the packed product in the longitudinal joint region of the inside of the packaging container.

The skived and double folded strip including the inside layer of PET is sealed to the outside of the inner edge partly by means of thermosealing along a narrow region in which the outermost longitudinal edge of the strip meets the non-skived outside layer of LDPE of the packaging laminate, and partly in that the hot melt glue applied for the longitudinal joint sealing flows out to the outermost edge of the strip and seals this against the unsplit packaging laminate in the inner edge.

The top and bottom portions of the packaging container are also fold formed in such a manner that exposure of incision edges to the packed product is precluded. One example of possible top and bottom fold formation techniques according to the invention is represented by a gable top package of the "Tetra Rex"® type. In order to avoid incision edge exposure in the fold formed bottom in such a packaging container, one of the bottom panels may, in a per se known manner, be provided with a small projection which may be folded outwards towards the outside of the packaging container and sealed in beneath the outermost bottom panel in order to turn the incision edge outwards away from the inside of the packaging container.

By, for example, such methods of skiving and panel folding, a packaging container is obtained in which all contact surfaces vis-à-vis the packed product on the inside of the filled and sealed container consist of the outer layer of PET.

The above-described packaging laminate, intended for a packaging container according to the present invention, is preferably produced by multilayer co-extrusion of two or more of the gas barrier layer, the adhesive layers and the aroma barrier layer on the one side of the core layer. It is naturally also possible to prefabricate a film of the inside layer of the packaging laminate which is laminated to a core layer or an LDPE-coated core layer. According to one preferred manner of manufacture, all layers are co-extruded on the inside of the packaging laminate by means of a five-layer extrusion nozzle on the core layer. According to another preferred manner of manufacture, the gas barrier layer, the adhesive layers and the aroma barrier layer may be co-extruded as four layers on a core layer coated with LDPE. According to an alternative, preferred manner of manufacture, it is possible to apply the gas barrier layer, the polyester layer and an interjacent adhesive layer by means of co-extrusion direct on the core layer.

The skived and double folded edge is sealed against the overlapping outer edge's inside with the aid of a hot melt glue possessing superior application, gluing and tightness properties, these properties being thoroughly retained even after lengthy cold storage, i.e. storage at refrigeration temperatures of approx. 4–8° C. for at least six weeks. A suitable hot melt glue for the present invention must provide good adhesion to different substrates and good resistance to cold, i.e. be flexible even at low temperatures. In the practical application according to the invention, it is thus desirable that the hot melt glue does not become brittle and lose its tacky and adhesion capabilities at cold storage temperatures, i.e. at approx. 4–8° C., even after a time as long as at least six weeks. At the same time, it is necessary that the glue has a high so-called tacking point and high viscosity in order to give sufficiently good adhesion properties to PET which in turn means that the molten glue must be applied at a relatively high temperature. Furthermore, a high tacking or softening point ensures that the longitudinal hot melt sealing joint will not be negatively influenced by the high sealing temperature of the subsequent intermittent transverse, or top and bottom, heat sealing operation, by re-melting or re-softening of the hot melt in the joint. A well-functioning example of such a hot melt glue is based on a copolymer of ethylene and vinyl acetate (EVA) in a composition with a tackifying rosin ester resin, the hot melt glue having a preferred thermal viscosity ("Thermosel") of approx. 30000–40000 cp, more preferably 36500 cp at 190° C. (375 F) (27/5.0) (alternatively less preferably, a Thermosel viscosity of approx 60000 cp at 177 C (350 F) (27/2.5) or approx. 25000 cp at 204 C (400 F) (27/5.0)), and a plasticising or softening temperature at approx. 80–100° C., preferably approx. 90–100° C. Preferably, for sake of optimal properties at cooling temperature, the hot melt composition comprises 50–70% by weight of EVA, 20–40% by weight of rosin ester resin and 5–15% by weight of a synthetic plasticising polymer, which has a similar type of plasticising effect as mineral oil, and has a density of about 0.96–0.98, more preferably about 0.97–0.98 g/cm3.

BRIEF DESCRIPTION OF THE ACCOMPANYING DRAWINGS

Figure 2:
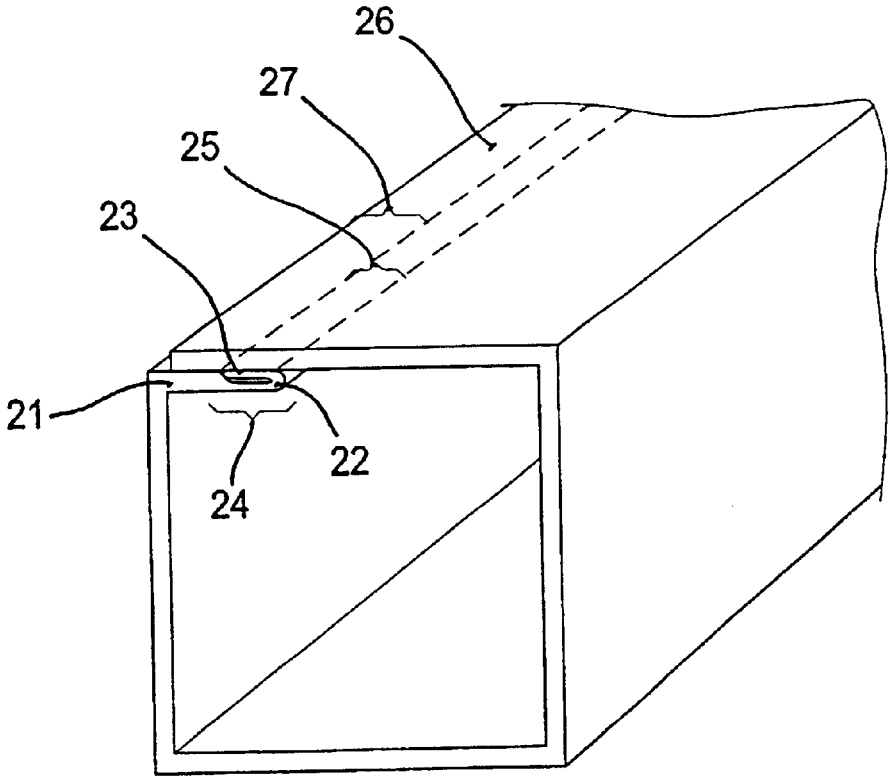
Figure 3:
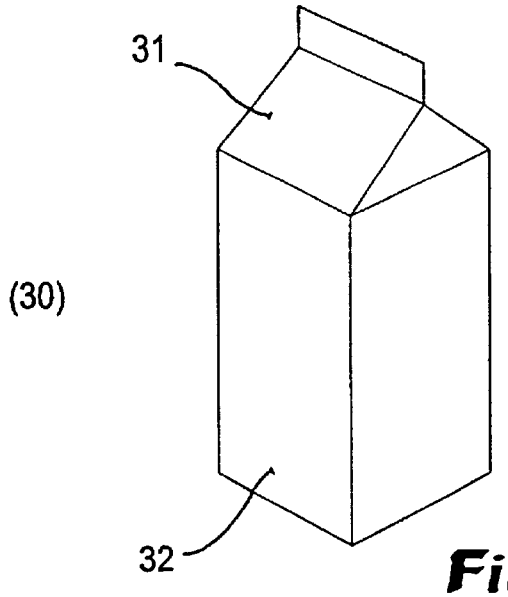
Figure 4:
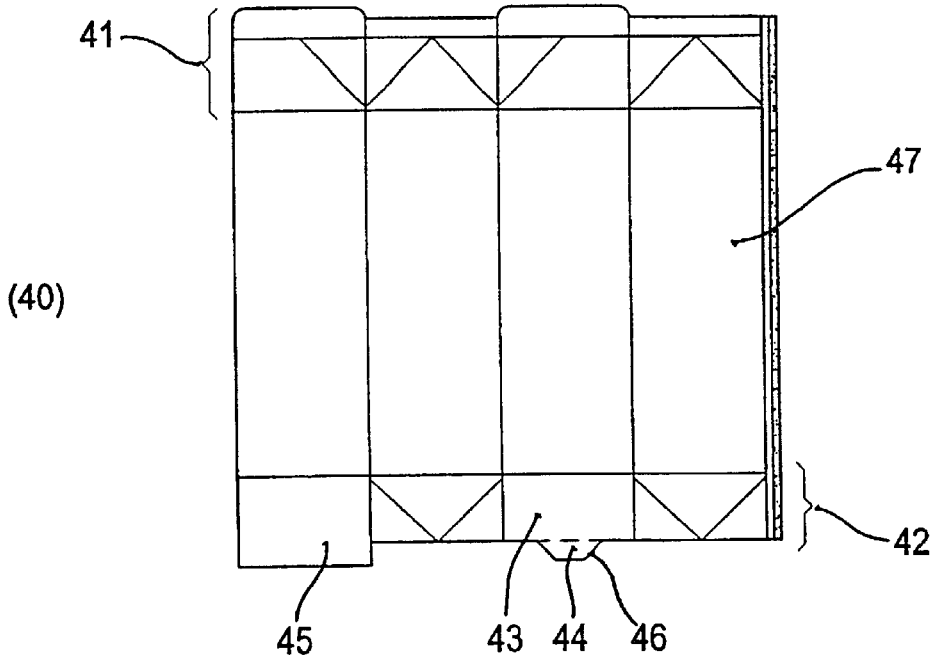

The present invention will now be illuminated/described in greater detail hereinbelow with reference to the accompanying Drawings, in which:

FIG. 1 schematically illustrates a cross section of a laminated packaging material for a packaging container according to the present invention;

FIG. 2, with a cross section through a longitudinally sealed tubular carton blank from a sheet-shaped blank of the packaging laminate of FIG. 1, schematically illustrates how the above-mentioned inner longitudinal edge in the packaging container is skived, folded back and sealed against the overlapping outer longitudinal edge;

FIG. 3 schematically illustrates a preferred packaging container according to the invention, produced from a blank of a packaging laminate according to FIG. 1 and longitudinally joint sealed according to FIG. 2; and FIG. 4 schematically shows the eventual appearance of a sheet-shaped packaging laminate blank according to the invention for the preferred packaging container of FIG. 3.

DESCRIPTION OF PREFERRED EMBODIMENT

FIG. 1 thus schematically illustrates a cross section of a laminated packaging material intended for a packaging container according to one preferred embodiment of the present invention, the packaging material carrying the generic reference numeral 10. The packaging laminate 10 comprises a core layer 11 of a paper of a packaging quality with a paper rigidity of approx. 280–340 mN.

The inside layer 12, i.e. the layer which is turned to face inwards in a packaging container produced from the packaging laminate for direct contact with the packed product, thus functions as a barrier layer against essential oils, such as, for example, D-limonen, and other polar flavouring substances, and consists of an amorphous, difficultly sealed PET such as, for example, "Eastapak 9921" from Eastman Chemical Company. The PET layer 12 is applied in a quantity of approx. 20–25 g/m$^2$, preferably approx. 20 g/m$^2$.

Between the above mentioned aroma barrier layer 12 and the core layer 11, there is disposed a layer 13 possessing superior gas barrier properties, substantially comprising a polyamide or a mixture of different polyamides. Preferably, a layer of approx. 8–12 g/m$^2$, most preferably approx. 10 g/m$^2$ of a PA of the type "Selar PA 3508"® from DuPont, or a layer of a mixture of PA-6 and another polyamide possessing superior processing and gas barrier properties, such as, for example, a polyamide of the type MXD-6.

On the inside, the core layer may be coated with a layer 14 of LDPE for good adhesion and lamination strength between the core layer and the remaining inside layers. Such an LDPE layer is preferably applied in a quantity of approx. 15 g/m$^2$.

Between the aforementioned layers 12, 13 and 14, there are preferably applied interjacent adhesive layers 15, 16, for obtaining a thoroughly integrated packaging laminate possessing good adhesion and lamination strength between the different laminate layers. Such adhesive layers 15, 16 preferably consist of maleic acid anhydride-modified polyethylene of the type Admer® or Bynel® and are preferably applied in a quantity of approx. 5 g/m$^2$ each. However, where applicable, the adhesive layer 15 may be omitted and the polyamide layer 13 thus directly extruded on the lamination layer 14, or alternatively the core layer 11.

Finally, the other, outer side of the core layer is provided with an outside layer 17 of LDPE, preferably in a quantity of approx. 12 g/m$^2$, for protecting the paper core layer against moisture and dirt on the outside of the packaging container.

The packaging laminate 10 is preferably produced in that the layers 12–16 are applied on the core layer by means of co-extrusion or in that the layers 12, 13, 15 and 16 are applied on a core layer 11 coated with an LDPE layer 14, by means of co-extrusion.

FIG. 2 shows how a sheet-shaped blank of the packaging laminate 10 has been reformed and longitudinally joint sealed into a tubular packaging blank 20 of square or rectangular cross section. The inner, longitudinal edge 21 has been skived along the edge so that a portion of the outer laminate layer has been removed to half of the thickness of the packaging laminate, and the inner laminate layers, including the PET layer 12, have been left in place in a projecting strip 22. The strip 22 has been folded back against the inner longitudinal edge's outside and sealed against the non-split outside layer 17 of LDPE in the edge of the skived region 23, by heating and the application of hot melt glue along the skived longitudinal inner edge 24 in a evenly applied strand, and thereafter compressed with the overlapping, outer longitudinal edge 25 for the formation of a durable and tight longitudinal sealing joint. Application of hot melt glue preferably takes place by means of roller application at a speed of at least approx. 380 m/min.

A method for such hot melt glue application and sealing has become the subject matter of a parallel application, cofiled on the same day by the same applicant, and entitled "A Method and an Apparatus for Producing Packaging Containers for Liquid Foods, as well as Packaging Containers". According to this method, a thin, uniformly thick and uniformly wide strand of the hot melt glue is applied with the aid of an applicator roller which is heated to an application temperature suitable for the hot melt glue, of at least approx. 180° C., preferably approx. 190–200° C., at most approx. 220° C., and whose circumferential surface is partly coated with a coating possessing good slippage or release properties vis-à-vis the hot melt glue. At lower temperatures than approx. 180° C., the glue adheres far too well to the surface of the roller and cannot be transferred in a sufficient quantity to the packaging laminate, while at temperatures higher than approx., 220° C., there is a risk of discoloration and degradation of both the hot melt glue and the remaining polymer layers included in the packaging laminate.

The applied quantity of hot melt glue is adapted to the size of the relevant sealing joint, but for a packaging container according to the invention, a hot melt glue strand is preferably applied of approx. 4–5 mm in width and approx. 50–100 $\mu$m, preferably approx. 60–70 $\mu$m, most preferably approx. 65 $\mu$m in thickness.

The double folded strip 22 has approximately the same thickness as the non-skived packaging laminate so that the sealing pressure may be distributed uniformly over the entire width of the overlapping sealing joint.

For optimum adhesion between PET surfaces and hot melt glue, a flame treatment of the applied hot melt glue strand, as well as the opposing sealing surface of PET, may be performed immediately prior to compression to form a sealing joint.

The overlapping portion of the outer, longitudinal edge 26 is sealed against the inner edge's outside layer of LDPE by means of thermosealing, which is made possible in that the LDPE surface along the overlapping region 26 of the inner edge 21 is first pre-treated with some surface activation treatment, preferably corona treatment.

FIG. 3 shows a preferred packaging container 30 according to the present invention, a so-called Tetra Rex® package. As a result of the typical gable top folding portion 31, no free incision edges are exposed to the packed product. In the bottom fold 32, incision edge exposure is avoided in that a small projection on one of the bottom panels is folded outwards, whereupon the incision edge of the projection is concealed behind the outermost bottom panel and instead the fold edge without incision edges comes into direct contact with the packed product.

FIG. 4 shows the preferable appearance of a sheet-shaped blank 40 of the packaging laminate 10 for producing a packaging container 30, with top folding portion 41, bottom folding portion 42 and side wall panels 47. The incision edge 46 of the inner bottom panel 43 will normally partly come into contact with the packed product, but is, thus, according to the present invention, provided with the projection 44 which is folded outwards under the bottom of the packaging container and sealed against the outer bottom panel 45.

While the present invention has been described in greater detail with reference to specific embodiments shown on the Drawings, it will be obvious to a person skilled in the art that various modifications and variations may be made without departing from the inventive concept as this is defined in the appended Claims.

From the foregoing description, it will thus be apparent that the present invention, in a simple manner and with simple means, satisfies the established objects and realises a packaging container with both retained good configurational stability and retained gas- and aroma barrier properties, even after lengthy cold storage, by a unique combination of edge covering, sealing by means of hot melt glue technique and a packaging laminate which has been optimised for the purposes of the packaging container. Tests on packaging containers according to the present invention have shown good shelf-life after at least six weeks at 8° C. and after at least ten weeks at 4° C. Moreover, the present invention realises a simple, rational manner of producing such packaging containers possessing good long-term cold storage properties according to the present invention.

What is claimed is:

1. A packaging container for the cold storage of liquid foods, and for retaining superior flavor and aroma properties in the packed product, the container being of the type which is produced by fold forming and sealing of a planar, substantially rectangular or quadratic packaging container blank including one or more side wall panels, top panels and bottom panels, for the formation of a tubular blank with a longitudinal overlap joint between first and second longitudinal edges of the packaging container blank, said tubular blank thereafter being given the desired bottom and top closures by fold forming and sealing of the bottom and top panels, respectively, of the packaging container blank, said packaging container blank being produced from a laminated packaging material including a core layer of paper or paperboard, an outer, aroma barrier layer of PET and a gas barrier layer disposed between the core layer and the aroma layer, the packaging container blank being fold formed and sealed such that all contact surfaces vis-a-vis the packed product on the inside of the filled and sealed container consist of the outer layer of PET, wherein said first longitudinal edge is skived and double folded outwardly against an outer surface of said first longitudinal edge; and a hot melt glue seal disposed between said skived and double folded edge of said first longitudinal edge and an inner surface of said second longitudinal edge, said hot melt glue seal retaining good adhesion and tightness properties during storage in cold storage temperatures of about between 4–8° C. and having a softening temperature of about between 80–100° C., said hot melt glue being based on a copolymer of ethylene and vinyl acetate in a composition with a tackifying rosin ester resin.

2. The packaging container as claimed in claim 1, wherein the top and bottom panels of the packaging container blank are formed, folded and sealed such that the longitudinal edges of the packaging container blank are protected against exposure to the packed product.

3. The packaging container as claimed in claim 1, wherein a bottom panel subjected to longitudinal edge exposure is provided with a projection which is folded outwards against the outside of the packaging container and inwardly sealed under an outer bottom panel for the purpose of placing the incision edge outside the inside of the packaging container.

4. The packaging container as claimed in claim 1, wherein the outer aroma barrier layer substantially consists of amorphous PET.

5. The packaging container as claimed in claim 1, wherein the gas barrier layer substantially consists of polyamide.

6. The packaging container as claimed in claim 1, wherein the core layer consists of paper with a paper rigidity of 280–340 mN.

7. The packaging container as claimed in claim 1, wherein the gas barrier layer is applied in a quantity of 5–15 g/m$^2$.

8. The packaging container as claimed in claim 1, wherein the outer aroma barrier layer of PET is applied in a quantity of 18–30 g/m$^2$.

9. A method of forming a packaging container, comprising the steps of:

providing a planar, substantially rectangular packaging container blank including side panel walls, top panels and bottom panels and being produced from a laminated packaging material including a core layer of paper or paperboard, an outer aroma layer of PET and a gas barrier disposed between the core layer and the aroma barrier layer;

skiving and double folding outwardly a first longitudinal edge of said packaging container blank against an outer surface of said first longitudinal edge; and sealing first and second longitudinal edges of the packaging container blank in an overlap longitudinal sealing joint by means of a hot melt glue for the formation of a tubular carton, said hot glue melt retaining good adhesion and tightness properties during storage in cold storage temperatures of about 4–8° C. and having a softening temperature of about between 80–100° C., wherein the packaging container blank is fold formed and sealed such that all contact surfaces vis-a-vis the packed produced on the inside of the filled and sealed container consist of the outer layer of PET.

10. The method as claimed in claim 9, wherein the hot melt glue is applied in the form of a substantially uniformly thick and uniformly wide strand in the gluing region on the outside of the skived and doubled-folded edge, and is then pressed against and sealed with the opposing longitudinal edge's inside.

11. The method as claimed in claim 9, wherein the doubled folded strip has the same thickness as the non-skived packaging laminate such that the sealing pressure is distributed uniformly over the entire width of the overlapping sealing joint.

12. The method as claimed in claim 9, wherein said sealing and application of hot melt glue take place by means of roller application at a speed of at least 380 m/min.

13. The method as claimed in claim 9, wherein the hot melt glue is applied at a temperature of 180–220° C.

14. The method as claimed in claim 9, wherein the packaging container's top and bottom panels are formed, folded and sealed such that the packaging container blank's incision edges are protected against exposure to the packed product.

15. The method as claimed in claim 9, wherein a bottom panel subjected to incision edge exposure is provided with a projection which is folded outwards against the outside of the packaging container and is inwardly sealed under an outer bottom panel for the purpose of placing the longitudinal edge outside the inside of the packaging container.

16. The method as claimed in claim 9, wherein the packaging laminate, for production of the packaging container blank, is produced by means of a co-extrusion of the aroma barrier layer of PET, the gas barrier layer of polyamide, the lamination layer of LDPE and both of the adhesive layers on the core layer.

17. The method as claimed in claim 9, further comprising the step of heat sealing the top and bottom panels of the packaging container.

18. A packaging container, comprising:

one or more side wall panels, top panels and bottom panels for the formation of a packaging container blank with a longitudinal overlap joint between longitudinal edges of the packaging container blank, said packaging container blank being produced from a laminated packaging material including a core layer of paper or paperboard, an outer, aroma barrier layer of PET and a gas barrier layer disposed between the core layer and the aroma layer; and a hot melt glue seal disposed along said longitudinal overlap joint, said hot melt glue seal retaining good adhesion and tightness properties during storage in cold storage temperatures of about between 4–8° C. and having a softening temperature of about between 80–100° C., said hot melt glue being based on a copolymer of ethylene and vinyl acetate in a composition with a tackifying rosin ester resin.

* * * * *